US005216331A

United States Patent [19]

Hosokawa et al.

[11] Patent Number: 5,216,331

[45] Date of Patent: Jun. 1, 1993

[54] ORGANIC ELECTROLUMINESCENCE ELEMENT AND LIGHT EMITTING DEVICE EMPLOYING THE ELEMENT

[75] Inventors: Chishio Hosokawa; Tadashi Kusumoto, both of Sodegaura, Japan

[73] Assignee: Idemitsu Kosan Co., Ltd., Tokyo, Japan

[21] Appl. No.: 799,201

[22] Filed: Nov. 27, 1991

[30] Foreign Application Priority Data

Nov. 28, 1990 [JP] Japan ..... 2-323229
Aug. 2, 1991 [JP] Japan ..... 3-216224

[51] Int. Cl.[5] ..... G09G 3/14
[52] U.S. Cl. ..... 315/169.3; 313/498
[58] Field of Search ..... 315/169.3; 313/498, 313/504, 506

[56] References Cited

U.S. PATENT DOCUMENTS 3,673,572 6/1972 Sliva et al. ..... 315/169.3 X
3,710,181 1/1973 Tanaka et al. ..... 315/169.3 X
3,753,231 8/1973 Hilsum ..... 315/169.3 X
4,882,517 11/1989 Maruyama et al. ..... 315/169.3 X

*Primary Examiner*—David Mis
*Attorney, Agent, or Firm*—Oblon, Spivak, McClelland, Maier & Neustadt

[57] ABSTRACT

An organic electroluminescence (EL) element has a RC time constant of 100 ns or less. Specifically, the capacitance of an organic EL element is 500 PF or less and/or the area of the light-emitting surface of the organic EL element is 0.025 $cm^2$ or less, while the electron transport time is 600 ns or less. On this manner, an organic EL element having a high response speed is obtained. An organic EL element having an extremely high speed may be obtained if the time constant of the organic EL element is 10 ns or less, both the hole transport time and the electron transport time is 40 ns or less and both the light emission rise complete time and the light emission decay complete time are 50 ns or less.

9 Claims, 5 Drawing Sheets

ORGANIC ELECTROLUMINESCENCE ELEMENT AND LIGHT EMITTING DEVICE EMPLOYING THE ELEMENT

BACKGROUND OF THE INVENTION

1. Field of the Invention

This invention relates to an organic electroluminescence element and a light emitting device employing the electroluminescence element.

2. Description Related Art

An organic electroluminescence element or an organic EL element, is an element having a light emitting layer formed of an organic molecular or organic macromolecular material exhibiting electroluminescent properties. It has ideal properties as a display element such as viewability from a wide viewing angle because cf autogenous light emission and superior shock proofness because it is a fully solid state element. For this reason, research and development are progressing in a number of technological fields.

In general, a high response speed is required as the useful properties of light emitting elements. Several reports have been made in connection with the response speed of the organic EL elements.

For example, it is reported that the response speed of organic EL elements is on the order of several microseconds (SDI Japan Display 89' Proceedings, page 760).

It is also reported that the response speed of organic EL elements is related to the capacitance and the inner resistance of the element, and that the response speed of the element is on the order of microseconds (J. Appl. Phys. 65(1989) 3610).

However, the organic EL element cannot be said to be satisfactory in response speed which is slower than the response speed of a light emitting diode of which response speed is on the order of several tens of nanoseconds.

Because of its slow response speed, the organic EL element cannot be used such as a light emitting diode conventionally employed as a light emitting and transmitting element in a photocoupler or a photointerrupter. The EL element can not be used as a light emitting element for light communication for the similar reason.

SUMMARY OF THE INVENTION

Object of the Invention

With the above described state of the art, it is an object of the present invention to provide an organic EL element having a faster response speed and a light emitting device employing the EL element.

Feature of the Invention

For accomplishing the above object, the present inventors have conducted eager research, and ultimately found that analyses of an equivalent circuit is of critical importance, i.e. that the analyses of the equivalent circuit has not been done and hence only the element with longer time constants have been obtained, which accounted for the low response speed of the conventional organic EL elements of the order of several microseconds.

As a result of our analyses of the equivalent circuits, the present inventors have first found that the value of the time constant (RC time constant) $\tau$ of the element is related with the capacitance C and the area of the element such that (i) it is necessary for the value of the time constant $\tau$ of the element to be 100 nanoseconds or less to produce a fast response of the element shorter than 1 microsecond, a fast response rate being obtainable with the value of the time constant $\tau$ of the element of 100 nanosecond or less; (ii) that the value of the time constant $\tau$ of the element of 100 nanosecond or less may be obtained with the capacitance C of the element of 500 PF or less, i.e. $C \leqq 500$ PF is equivalent to $\tau \leqq 100$ ns; (iii) the value of the capacitance C of the element of 500 PF may be obtained with the area of the light-emitting surface of the element of 0.025 $cm^2$ or less; and that (iv) if particularly necessary, the value of the time constant $\tau$ of the element may be diminished to 10 nanosecond (ns) or less.

It has also been found in the second place that, if the element is driven such that it is actually connected to a power source, that actual value of the time constant $\tau$ becomes larger due to the inner resistance in the power source or to the resistance of a wiring connection to the element, in a manner different from the case wherein the element is driven by an ideal driving circuit or power source of the equivalent circuit, so that the driving circuit needs to be designed so that the actual value of the time constant is 100 nanoseconds or less, if particularly necessary, 10 nanoseconds or lower.

It has also been found in the third place that, in order to reduce the rise time and decay time in light emission of the element, the charge transport time needs to be reduced to 600 nanoseconds or less and that, in order for the rise in the light emission to be completed within an ultra high speed response time of not longer than 50 nanoseconds, the charge transit time need to be shorter than 40 nanoseconds. These findings have led to realization of the present invention.

Thus, with the organic EL element of the present invention, the time constant of the element is 100 nanoseconds or less and/or the capacitance of the element is 500 PF or less and the charge transport time is 600 nanoseconds or less, whilst the area of the light emitting surface of the element is 0.025 $cm^2$ or less and the charge transport time is 600 nanoseconds or less. When a plurality of the elements are connected together in series, the time constant of the resulting series connection is set so as to be 100 nanoseconds or less and/or the sum of the capacitances of the elements is 500 PF or less and the charge transport time of each element is set so as to be 600 nanoseconds or less. If particularly necessary, the time constant $\tau$ of the element is set so as to be 10 nanoseconds or less.

Furthermore, with the above described organic EL element of the present invention, the time constant of the element is 10 nanoseconds or less and the hole transport time and the charge transport time are both 40 nanoseconds or less whilst the full rise time and the full decay time of light emission are both 50 nanoseconds or less.

The light emitting device of the present invention is constituted by the above described organic EL element and a driving circuit in which the time constant as measured actually on driving the element is not in excess of 100 nanoseconds, if particularly necessary, is 10 nanoseconds or lower.

A photocoupler of the present invention employs the above described organic EL element as a light emitting element for light transmission.

A light emitting device for light communication according to the present invention includes a modulatable power source connected to the above described organic EL element of the present invention.

According to the present invention, an organic EL device with a fast response speed may be obtaind.

The organic EL element or the light emitting device of the present invention, having the fast response speed, may be utilized as a photocoupler, a photointerrupter or as a light emitting device for light communication.

DESCRIPTION OF THE PREFERRED EMBODIMENTS

The present invention will be explained in more detail herein below.

With the organic EL element of the present invention, the time constant of the element is selected to be 100 nanoseconds or less. The time constant of the element is explained with reference to an equivalent circuit thereof.

Figure 1:
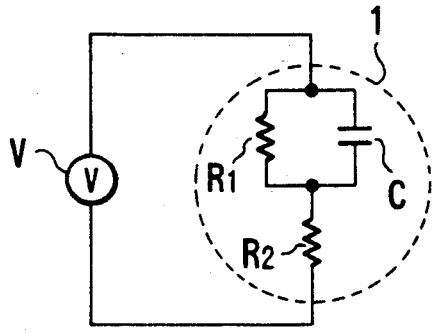
FIG. 1 shows an equivalent circuit of an organic EL element.

In general, the equivalent circuit of an organic EL element is constructed as shown in FIG. 1.

Figure 2:
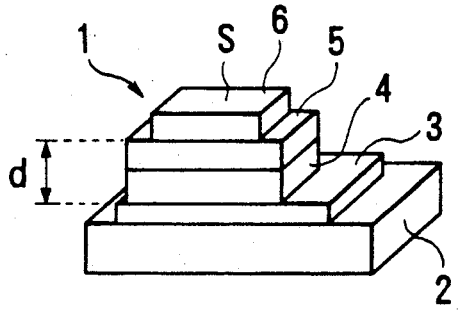
FIG. 2 is a perspective view showing an example of an organic EL element of the present invention.

In this figure, 1 is an organic EL element constituted by stacking a glass substrate 2, an ITO electrode (anode) 3, a hole injection layer 4, a light emitting layer 5 and a cathode (Mg; Ag) 6, step by step, as shown in FIG. 2.

C is a capacitance of the element which, with an area S and a film thickness d of the element, is expressed by the formula (1) (see FIG. 2), $$C = \frac{\epsilon o\, \epsilon r\, S}{d} \tag{1}$$

where $\epsilon o$ is the permittivity (dielectric constant) in vacuum and $\epsilon r$ is the relative permittivity of an organic layer. The value of the capacitance C, which depends on the film thickness of the organic layer, is 40 to 10 nF/cm$^2$ for the total film thickness 60 to 260 nm of a light emitting layer and a charge transport layer (hole injection layer) used as an organic layer summed together. The capacitance value is proportional to the area of the element.

$R_1$ is a resistance connected in parallel with capacitance C and composed of resistances in the charge transport layer and the light emitting layer of the element and a resistance at an interface between an electrode and the organic layer (the charge transport layer or the light emitting layer).

The resistance $R_1$ becomes smaller with an increase in the applied voltage and is typically approximately equal to several tens to 100 ohm per cm$^2$ when a forward voltage V of 5 to 10 V is applied to the element. This resistance of the element is inversely proportionate to the area of the element surface.

$R_2$ is a resistance connected in series with the capacitance C and is composed of a resistance of the electrode and a wiring resistance of the element. The resistance $R_2$ is usually 1 to 100 ohms.

V is a power source driving the element.

The time constant $\tau$ of the equivalent circuit shown in FIG. 1 is shown by the following formula (2):

$$\tau = \frac{CR_2}{1 + \frac{R_2}{R_1}} \tag{2}$$

The time constant $\tau$ is related with C, $R_1$ and $R_2$ as shown in the formula (2) above, so that, if the values of C and $R_2$ are reduced, the value of the time constant $\tau$ becomes smaller. Since the capacitance C is proportional to the area S of the element surface, the value of the time constant $\tau$ becomes smaller with reduction in the area S of the element surface. On the other hand, since the resistance $R_2$ is mainly composed of the wiring resistance and is not related closely with the area of the element surface so that its effect on the time constant $\tau$ is relatively small.

From the above it is apparent that, for reducing the value of the time constant $\tau$, it suffices to reduce the capacitance C of the element and, to this effect, it suffices to reduce the area S of the element surface.

It is also seen that the film thickness d of the element in the formula (1) or the relative permittivity sr may also be changed for reducing the capacitance C.

The area of the surface of the conventional organic EL element is 0.2 cm$^2$ or more. By reducing the area so as to be smaller than in the conventional element, the capacitance C may be set so as to be not larger than 500 PF ($C \leqq 500$ PF). Since $R_1 >> R_2$, $\tau$ $CR_2 \leqq 100$ ns, from the formula (2), so as to provide a basis for the preparation of the element having fast response characteristics. The value of $\tau$ $CR_2$ (for $R_1 >> R_2$) may be calculated from the values of C and $R_2$.

As for the value of the time constant $\tau$ of the element, preferably $CR_2 < 50$ ns and more preferable $CR_2 < 10$ ns. The corresponding value of the capacitance C is preferably not more than 500 PF and more preferably not more than 200 PF.

Therefore, with the thickness of the organic layer of 130 nm, the area of the element surface is not more than 0.01 cm$^2$. Although it is possible to increase the film thickness and decrease the capacitance of the element, the film thickness of 300 nm or more is not desirable because the light emitting efficiency of the element is reduced and the element driving voltage is not more than 20 V. Thus it is most preferred that the film thickness and the capacitance of the element be 300 nm or less and 200 PF or less, respectively.

Since the wiring capacitance of ITO markedly contributes to the resistance $R_2$, wiring connection is preferably so made that, except for the resistance of the electrode portion taking charge of the light emission of the element (portion 3 of ITO electrode in FIG. 2), the resistance should be not more than several ohms.

Meanwhile, when plural organic EL elements are connected together in series, it is preferred that the time constant of the series connection be not more than 100 ns and/or the sum total of the capacitances of the element be not more than 500 PF. Above all, for producing a high speed EL element, it is preferred that the elements be connected together in series to reduce the capacitance of the elements. The elements are preferably connected together so that the voltage be applied in the forward direction. However, attention should be paid to the fact that the element driving voltage amounts to several times that for each of the elements connected together in series. It should be remarked in this connection that, for producing ultra high speed organic EL elements, the time constant of the element be selected to be 10 nanoseconds or less.

Meanwhile, when driving the organic EL element using an actual power source, the actual value of the time constant $\tau$ becomes larger than the theoretical value on account of the inner resistance in the power source or the wiring resistance with the elements. It is therefore necessary that the EL element be driven by a driving circuit for which the actual time constant is 100 ns or less, preferably 10 ns or less, as will be explained subsequently.

It is noted that the light emitting response behavior of the element is not determined solely by the time constant $\tau$ and that the charge transport involved in the charge injection, a transfer and recombination process is necessary until start of light emission, while the rise time is necessary until a stabilized steady state of light emission is established.

The light emitting mechanism of the organic EL element is hereinafter explained.

The light emitting mechanism of the organic EL element is explained in EP 0281382 by Tang et al.

Figure 3:
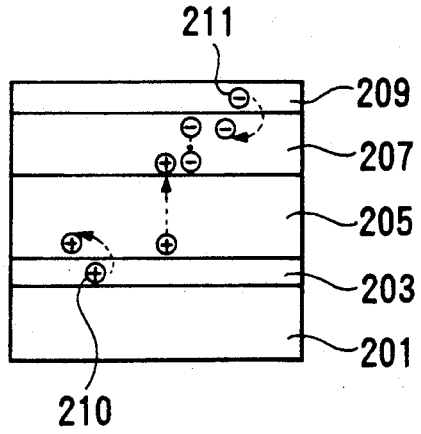
FIG. 3 is an explanatory view showing a light emitting mechanism of an organic EL element.

Referring to FIG. 3, a transparent electrode 203 (anode) is supported on a substrate 201. A hole transport region 205 is disposed on the anode 203, and an electron transport region 207 is disposed on the transport region 205 in tight contact with a cathode 209.

In the hole transport region 205, holes are transported to a recombination region where the holes are recombined with the electrons to produce an excited state of the molecules of a light emitting material. The region 205 includes a portion of a hole injection layer or a light emitting layer. In the electron transport region 207, electrons are transported to the recombination region. The region 207 includes a portion of an electron implanting layer or the light emitting layer.

When the power source is turned on, a positive (+) voltage and a negative (−) voltage are applied, after lapse a time $\tau$, to the anode 203 and the cathode 209, respectively. In this manner, the holes are injected from the anode 203 into the hole transport region 205. The holes 210 are transported, under an electrical field generated by the impressed voltage, in the direction of the electron transport region 207 through the hole transport region 205. If the electron transport region 207 includes the light emitting layer, the light emitting layer exists in a portion within the electron transport region 207 which is in intimate contact with the hole transport region 205. The holes transported in this portion are injected into the light emitting layer from the hole transport region 205.

On the other hand, after application of the electrical voltage, electrons 211 are injected from the cathode 209 into the electron transport region 207 and transported under the electrical field through the electron transport region 207 before reaching the light emitting layer. The electrons and the holes are responsible for the excited state of the molecules of the light emitting material, and light is emitted on reversion to the ground state.

As will be apparent from the above described principle of light emission, the transport time of charges, i.e. electrons and holes, is necessary for starting light emission in the element, besides the time $\tau$ necessary for an electrical voltage to be impressed substantially on the element.

If the mobility of a hole is $\mu h$, that of an electron is $\mu e$, the film thickness of a hole transport region 205 is $d_h$ and the film thickness of the electron transport region 207 is $d_e$, the charge transport time T is given by the formula $$T = \max\left(\frac{d_h}{\mu h \cdot E} \cdot \frac{d_e}{\mu e \cdot E}\right) \quad (3)$$

where E is the strength of the electrical field such that E (impressed voltage)/(dh+de), $T = d_h/\mu h.E$ and $Te = d_e/\mu e.E$.

Meanwhile, the operator max (X,Y) denotes the value of X or the value of Y, whichever is larger.

As will be clear from above, larger values of the mobility $\mu h$ in the hole transport region 205 and the mobility $\mu e$ in the electron transport region 207 are preferred. The time T during which the charges are moved through a region of 60 nm under the strength of the electrical field of $1\times10^6$ V/cm is 600 ns for the mobility of $1\times10^{-5}$ cm$^2$/v.sec. Therefore, in order for the rise in light emission to be completed in 1 microsecond or less, a mobility not less than $1\times10^{-5}$ cm$^2$/v.sec is preferably needed for a region having a film thickness of 60 nm. For achieving a rise complete time for light emission of not longer than 1 microsecond for an arbitrary film thickness, the film thickness and mobility are set so that the transport time is not longer than 600 ns.

If the material for the hole transport region is a triphenylamine derivative, styrilamine derivative, distyrilamine derivative or a hydrazone derivative, as disclosed in EP 0281382, the mobility of the holes is $10^{-3}$ to $10^{-4}$ cm$^2$/v.sec. The mobility $\mu h$ of $\mu h > 2\times10^{-4}$ cm$^2$/v.sec may be achieved easily if the hole injection layer or the light emitting layer is formed of any of these materials. With the film thickness of not more than 75 nm, Th<40 ns may be achieved for the strength of the electrical field of not lower than 1 MV/cm.

On the other hand, only few materials exhibiting high electron mobility are presently known, and the charge transport time T is determined in a majority of cases by the electron mobility of a material employed for the electron transport region. The mobility is preferably on the order of $10^{-5}$ cm²/v.sec or more and more preferably $8\times10^{-5}$ cm²/v.sec or more.

If the film thickness of the electron transport region is to be especially reduced to, for example, 0 to 20 nm, the charge transport time T may be diminished to satisfy Te<50 ns. However, it may be estimated that a material with the mobility $\mu e$ of $10^{-3}$ to $10^{-4}$ cm²/v.sec may be found in the future with progress in the research into the materials for the electron transport region. The information of the present invention may be utilized fully for such case.

The rise time is necessitated until a stable steady state of light emission is reached.

Figure 4:
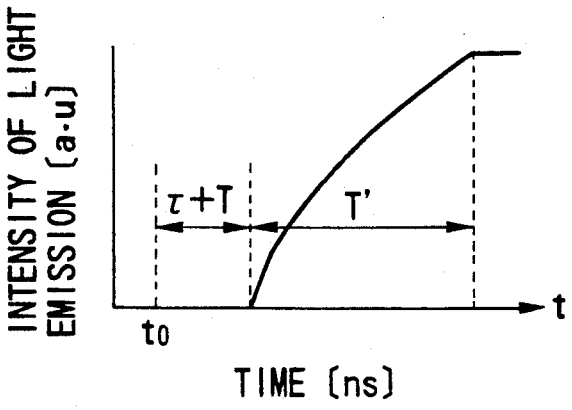
FIG. 4 is a graph showing the rise of light emission in an organic EL element.

Referring to FIG. 4, if a power source is turned on at time $t_o$, holes and electrons are recombined after time $\tau+T$ so that light emission is started. However, a rise time T' is necessitated until the light emission reaches the stable steady state, that is, until light emission is completed. It has been found that the rise time T' and the transport time T depend appreciably on the capacitance C of the element and hence on the time constant $\tau$. Specifically, it has been found that, while $\tau+T+T'$, that is, the rise complete time, is on the order of 1 microsecond or more for $\tau>100$ ns, the rise complete time $\tau+T+T'$ is substantially shorter than 500 ns under the condition of $\tau<20$ ns, as shown in Table 1. If T and T' are not dependent on the time constant $\tau$, the rise complete time $\tau+T+T'$ is changed by a variance (80 ns) of $\tau$ so that the rise complete time can not be changed by as much as 500 ns or more.

Although the reason is not clear at present, it may be presumed that, unless a voltage is applied quickly to the element, the strength of the electrical field E may reach its steady state with a delay, so that an unexpectedly long time is necessitated until charge injection and transport is achieved under a steady state.

It has now been found that, for reducing the rise complete time of light emission $\tau+T+T'$, it is more effective to reduce the time constant $\tau$.

For increasing the response speed of the element, it is necessary to diminish the decay complete time of light emission. It has now been found that, if the time constant $\tau$ is larger and reaches 100 ns or more, a residual electrical field is produced and the charge injection is raised in the element during the time $\tau$ even after the power source is turned off, so that a time more than necessary is involved in completing the decay of light emission to render fast response difficult. Above all, it has been found that the capacitance of the element be preferably set so that $\tau<20$ ns or, occasionally, $\tau<10$ ms.

Figure 5:
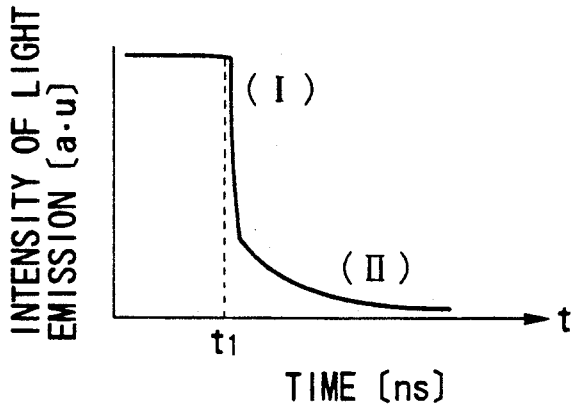
FIG. 5 is a graph showing the decay of light emission in an organic EL element.

FIG. 5 shows the state of rising of light emission when the capacitance of the element is set so that $\tau<20$ ns. If the power source is turned off at time $t_1$ in FIG. 5, decay occurs acutely as indicated at I.

The area I represents an area of an exponential relaxation in which decay occurs at a rate corresponding to the life of fluorescence of molecules comprising the light emitting layer. The time involved for this area is usually 50 ns or less. The time corresponds to the time of relaxation from the excited state generated before $t_1$ to the ground state, and represents a fast decay of light emission. The area (I) in FIG. 5 is governed by the life of fluorescence, as discussed above. Therefore, the shorter the life of fluorescence, the faster is the decay of light emission. The life of fluorescence is preferably not longer than 100 ns and more preferably not longer than 20 ns.

An area (II) is an area of prolonged relaxation resulting from recombination of holes and electrons left in the light emitting layer. A constant characterizing this area is a recombination constant, which is a rate constant for the rate of recombination of the electrons and the holes producing the excited state.

Figure 11:
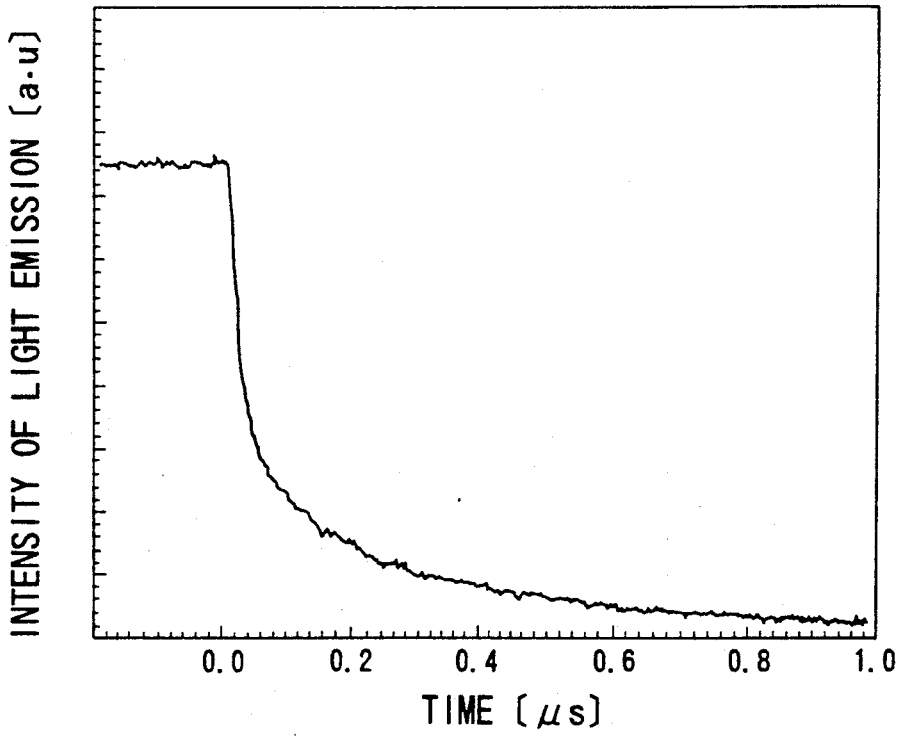
FIG. 11 is a graph showing the decay in light emission of the light emitting device prepared in accordance with the Examples.

The present inventors have conducted a model analysis on the basis of the data shown in FIG. 11, and arrived at a value of $(1/n_o r)=330$ ns, where $n_o$ is an electron density under an equilibrium state and r is a recombination constant, with an element ITO / TPD / Al-$(O_x)_3$ / Mg; In. If the value for $n_o$ is estimated to be $10^{14}$ to $10^{15}$ cm$^{-3}$, $r=3\times10^{-9}$ to $3\times10^{-8}$ cm$^{-3}$s$^{-1}$, which is smaller than $(3\pm2)\times10^{-6}$ cm$^{-3}$s$^{-1}$ (Phys. Stat. sol. A 6,231), which is a value obtained with an anthracene single crystal. This indicates that the value of r can be increased by using a light-emitting material or a light-emitting source of a higher quality. Supposing that r is on the order of $10^{-6}$ cm$^{-3}$s$^{-1}$, the value of $(1/n_o r)=3$ ns or thereabouts may be obtained. This value is particularly favorable because it indicates that a decay area extending over a prolonged time in the decay of light emission may be safely disregarded.

Figure 13:
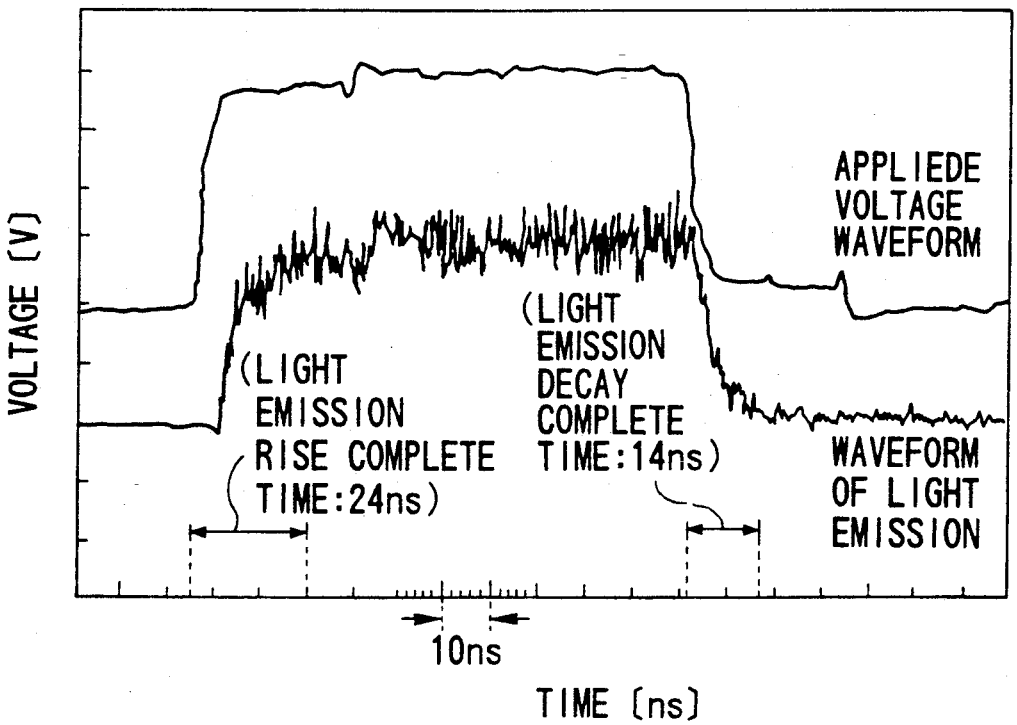
FIG. 13 is a graph showing an impressed voltage waveform and a light emission waveform of another organic EL element prepared in accordance with the Examples.

It has also been found that there also exists an area with a smaller long life relaxation (Example 7 and FIG. 13). This is particularly preferred because the rise of light emission is terminated substantially with only the area (I). Longer life components are probably caused not only by recombination as discussed above, but also by light emission by electroluminescence from the state of triplet excitation or by light emission due to electroluminescence caused by the recombination of trapped residual charges. These longer life components need to be removed.

By using a particularly desirable one of the above described factors, with the exclusion of the recombination constant, it is possible that a time of a rise completion for light emission which is necessary to reach 90% of the steady state light emission is less than 300 ns. The maximum response frequency of the element may be estimated from this response time to be f=1/(response time). Since f=1/300 ns=3.3 MHz, it can be seen that the organic EL element having a frequency response property of at least 3.3 MHz may be obtained.

If, above all, the time constant of the element is 10 ns or less, Te<40 ns and Th<40 ns, the light emission rise complete time may be 50 ns or shorter. Since relaxation is governed only by the life of fluorescence if the long life relaxation component may be disregarded, the light emission decay complete time may be set so as to be not more than 50 ns for a shorter life of fluorescence, for which the response frequency is 20 MHz.

The preparation and the component materials for the organic EL element of the present invention is hereinafter explained.

The organic EL element of the present invention is preferably formed on a substrate. There is no particular limitation the starting materials for the substrate and any of the materials conventionally used for the organic EL elements, such as glass, transparent plastics or quartz, may be employed. The substrate thickness is preferably 10 times or more that of the organic EL element.

As the materials for electrodes (anode or cathode), transparent electrode materials, such as metals, e.g. gold, aluminum, indium, magnesium, copper or silver, alloys or mixtures thereof, alloys or mixtures disclosed in JP Patent KOKAI Publication No. 63-299695(1988), ITO (indium tin oxide; a mixed oxide of indium oxide and tin oxide), $Sn\ O_2$ (stannic oxide)or ZnO (zinc oxide), may be employed.

Metals or electrically conductive compounds having a higher work function are preferably employed for an anode, whilst metals or electrically conductive materials having a lower work function are preferably employed for a cathode.

At least one of the electrodes is preferably transparent or semi-transparent for raising the light transmittivity. The electrode thickness is preferably 10 nm to 1 μm and, above all, not more than 200 nm, for raising the transmittivity.

The electrodes may be formed in any known manner, such as by vapor deposition or sputtering.

The organic layer, including at least a light emitting layer formed of organic compound, may consist only of a light emitting layer, a light emitting layer/a hole injection layer, an electron transport layer/light emitting layer, or of an electron transport layer/light emitting layer/a hole injection layer, or in any other manner as described in JP Patent Application No. 1-068387(1989). In the firstly stated case, the organic layer includes a sole layer. The sequence of the component layers of the organic layer may be reversed.

The light emitting layer has injection, transporting and light emitting functions.

The injection function means the function of enabling holes to be injected by the anode or the hole injection layer on application of an electrical field, and the function of enabling electrons to be injected by the cathode or the electron injection layer.

The transporting function means the function of moving or transporting holes and electrons under the force of an electrical field.

The light emitting function means the function of providing a site for recombination of holes and electrons and of causing light emission.

The capability of hole injection may differ from that of electron injection. The light emitting layer is preferably in the range of from 5 nm to 5 μm.

Although it is not absolutely necessary to provide the hole injection layer and the electron injection layer, they are preferably provided for improving the light emitting properties.

The hole injection layer is formed of a material capable of transporting holes to the light emitting layer under a lower electrical field. The mobility of holes is preferably at least $10^{-6}$ $cm^2$/v.sec under the electrical field of $10^4$ to $10^6$ v/cm.

The electron injecting layer is formed of a material capable of transporting electrons to the light emitting layer under a lower electrical field.

Although there is no limitation to the method for preparing the above described organic EL element, the method of vapor deposition is preferred because the organic EL element may thereby be prepared in one process with advantages in equipment and production time.

The above described organic EL element may be prepared by aging by impressing a voltage across the anode and the cathode.

The aging herein means applying an electrical voltage to eliminate a region liable to produce leakage currents as well as to remove holes or electrons accumulated in the element (see JP Patent Application No. 2-117885). In this manner, the organic EL element may be operated stably. The organic EL element employed in the method of the present invention need not necessarily be processed by aging. However, aging is preferred for the sake of stabilizing the element operation.

The light emitting device of the present invention will be hereinafter explained.

The light emitting device of the present invention is adapted to be driven by a driving circuit (power source) which is so designed that the time constant during driving of the element is not in excess of 100 ns and occasionally 10 ns.

The driving circuit is preferably so designed that a short pulse voltage may be applied during rise time and decay time. A pulse generator capable of applying a pulse voltage with the rise time and the decay time of not longer than 20 ns, preferably not longer than 1 ns, is preferred.

Figure 6:
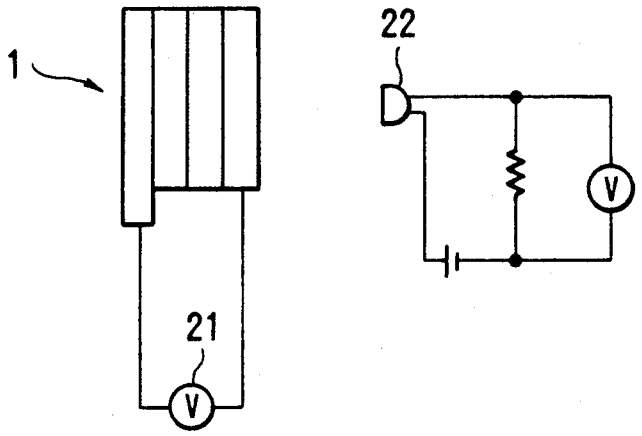
FIG. 6 is a schematic circuit diagram of a photocoupler of the present invention.

The above described organic EL element and light emitting device of the present invention may be used as a light emitting transmitting element and a light emitting which is in need of frequency response characteristics of 20 MHz). (max. 50 MHz). That is, if the organic EL element 1 of the present invention is driven by a pulse power source 21 shown in FIG. 6 to produce the light emitting, interrupting or demodulating state, a pulse train is regenerated by a light receiving element 22 facing the power source.

In this manner, an electrical-electrical conversion device may be provided by making a light emitting portion of the organic EL element of fast response characteristic and by making a light receiving portion of a light emitting element such as existing silicon photodiode, silicon PIN photodiode, avalanche photodiode or photomultiplier.

Figure 7:
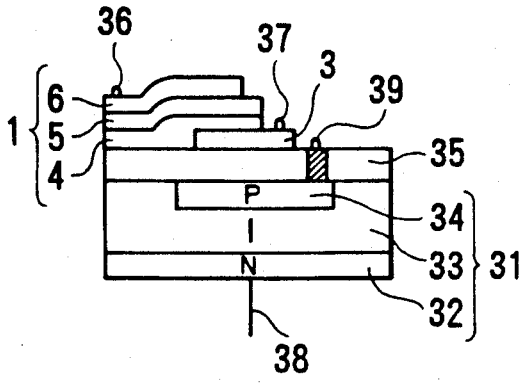
FIG. 7 is a front view showing an organic EL element of the present invention, as formed on a PIN diode.

Further, by forming an organic EL element on a substrate of a light receiving element, formed of a semiconductor, such as a silicon photodiode, an integrated circuit of a photocoupler or a photointerrupter may be easily provided. FIG. 7 shows an example of such an integrated circuit of a photocoupler in which the organic EL element 1 is formed on a PIN photodiode 31. The PIN photodiode 31 is composed of an N-layer 32, an I-layer 33 and a P-layer 34. An $SiO_2$ window material 35 is deposited on the P-layer 34, and the organic EL element, similar to that shown in FIG. 2, is formed on the window material 35. If a voltage waveform of 3 to 15 V is applied across an electrode 36 as a cathode and an electrode 37 as an anode, an electromotive force is generated across electrodes 38, 39 of the PIN photodiode 31. Since the organic EL element of the present invention exhibits fast response characteristics, electrical-electrical conversion with a frequency modulation on the order of MHz may be achieved by utilizing a high speed light receiving section.

The organic EL element of the present invention may be utilized as a light emitting device for light communication if the EL element is connected to a modulatable power source, in which case the light emitting and receiving devices are connected together by an optical fiber cable.

Conversely, if a high speed light receiving element, such as PIN photodiode, is combined with a high speed organic EL element, and changes of voltage which are caused by the light modulation incident on the light receiving element are applied across the organic EL element, high speed light-light conversion may also be achieved.

EXAMPLES

The present invention will be explained with reference to Examples and Comparative Examples. It is to be noted that these Examples are given by way of illustration only and are not intended for limiting the invention.

EXAMPLE 1

Preparation of High Speed Organic EL Element

A glass substrate fitted with an electrode of ITO ($In_2O_3$; Sn), with a film thickness of 100 nm, prepared by HOYA KK, was ultrasonically washed for five minutes with isopropyl alcohol, and then immersed in isopropyl alcohol. The glass substrate was then taken out and dried by blowing with dry $N_2$, after which it was rinsed for five minutes with a UV-ozone cleaning device (UV 300 prepared by SAMCO INTERNATIONAL KK) so as to be used as a supporting substrate. This substrate was then mounted on a substrate holder of a vacuum deposition system prepared by NIPPON SHINKU GIJUTSU KK. On the other hand, a Mo evaporation boat contained TPD (N,N'-diphenyl-N,N'-di(3-methylphenyl)-4,4'-diaminobiphenyl) and a Mo evaporation boat contained $Al(O_x)_3$ (Al complex of 8-hydroxyquinoline) were mounted on a terminal block adapted for current conduction and a vacuum chamber was evacuated to $10^{-6}$ Torr. Current conducted through a TPD boat for vacuum deposition of TPD to produce a layered assembly of the glass substrate/ITO/PPD. The rate of TPD deposition was 1 to 3Å/sec, the film thickness was 60 nm and the substrate temperature was the ambient temperature. Current was them supplied to the boat of $Al(Ox)_3$ for depositing an Al(Ox)3 layer on the glass substrate/ITO/TPD layered assembly. The TPD deposition rate at this time was 1 to 2Å/sec, the film thickness was 60 nm and the substrate temperature was the ambient temperature.

The vacuum chamber was then opened and a stainless steel mask was placed on the resulting glass substrate/ITO/TPD/Al(Ox)3 assembly. The resulting assembly was then mounted on the substrate holder. The mask area was 0.5 $mm^2$ ($1\times0.5$) to provide a light emission area of the element. A Mo boat contained Mg and a W filament contained in were fitted on a terminal block for current conduction and the vacuum chamber was evacuated to a vacuum of $6\times10^{-7}$ Torr. Current was supplied through the Mg containing boat for vacuum deposition of Mg at a deposition rate of 14 Å/sec. Current was simultaneously supplied to the In-containing boat for depositing In at a rate of 0.6 to 0.9 Å/sec. By such dual deposition, Mg; In was formed to a thickness of 90 nm, while Mg; In was used as a cathode.

Figure 8A:
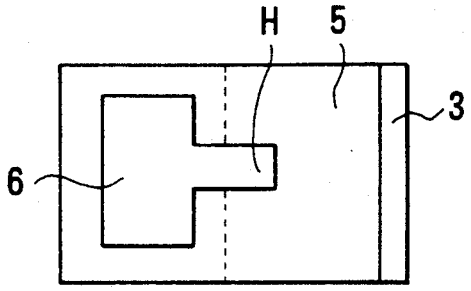
FIG. 8*a* is a plan view of an organic EL element prepared in accordance with Examples of the present invention.
Figure 8B:
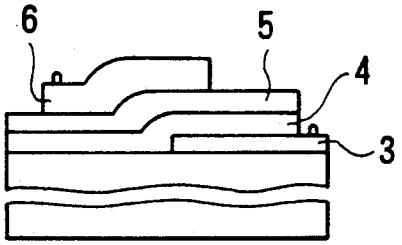
FIG. 8*b* is a front view thereof.

The produced element is shown in a plan view of FIG. 8*a* and a cross-sectional view of FIG. 8*b*. A region H delimited by an Mg; In 6 and an ITO 3 represents a light-emitting region of the element. For reducing the wiring resistance of the ITO, the point of connection of the anode to the power source was selected to be closer to this light-emitting region. The capacitance of the element was found to be 100 PF. Although $R_1$ was not known, $R_2$ was found to be 25 ohms. Thus the time constant $\tau$ was estimated to be 2.5 ns. Although $R_1$ was not known, $R_1 >> R_2$ because of the small element area.

EXAMPLE 2

Preparation of a Light-Emitting Device (Measurement of Light Emission Response Time)

Figure 9:
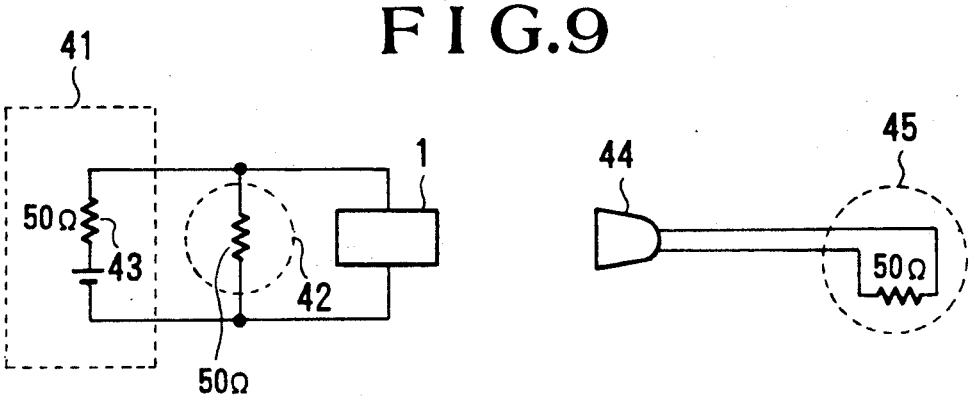
FIG. 9 is a schematic circuit diagram showing a light emitting device prepared in accordance with Examples of the present invention.

A pulse generator 41, capable of applying a pulse voltage providing a rise time of and a decay time of approximately 20 ns each, was used in association with a circuit shown in FIG. 9. The organic EL light emitting element 1, prepared in accordance with Example 1, was connected in circuit with the pulse generator 41 as shown in FIG. 9 to provide a light emitting device. An oscilloscope 42 with a high bandwidth was also connected as shown in FIG. 9. The oscilloscope has an equivalent resistance of 50 ohms as indicated by a dotted line. The inner resistance 43 of the power source was 50 ohms.

The theoretical or calculated value of the time constant is shown by the following formula (4):

$$\frac{C(R_2+25)}{1+\frac{R_2+25}{R_1}} \quad (4)$$

On the other hand, the waveform of light emission from the organic EL element was measured with a high speed oscilloscope 45, having an enclosed terminal resistance of 50 ohms, using a photoelectron multiplier 44 (R 928 prepared by HAMAMATSU PHOTONICS KK) as a light receiver adapted for measuring high speed response characteristics.

Figure 10:
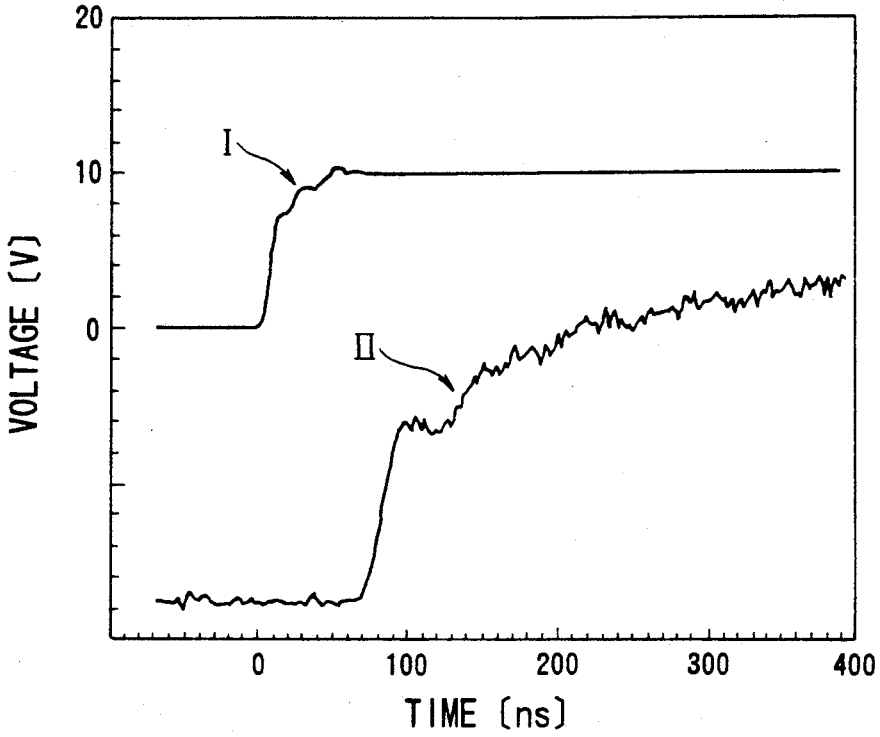
FIG. 10 is a graph showing the rise in light emission of the light emitting device prepared in accordance with the Examples.

FIG. 10 shows a voltage waveform I (voltage, 10 V) applied across the EL element, as measured with the oscilloscope 42. The waveform of the applied voltage rises acutely, demonstrating that the time constant of the element is less than 20 ns. The corresponding waveform of the light emission II indicates that the time until the light emission is initiated is equal to $\tau+T\leqq70$ ns. The time elapsed until the waveform of light emission reaches 90% of the equilibrium state is equal to $\tau+T+T'=260$ ns, thus indicating the high speed response characteristics.

Measurement of time constant $\tau$ is hereinafter explained.

After the time equal to time constant $\tau$, the voltage measured by the oscilloscope is as shown by the formula (5):

$$\text{(Voltage after time constant } \tau) = \text{(Voltage of equilibrium state)} \times \left\{1-\frac{1}{e}\left(1-\frac{\frac{25}{R_1+R_2}+1}{\frac{25}{R_2}+1}\right)\right\} \quad (5)$$

Since $1+(25/R_1+R_2)$ 1 and $1+(25/R_2)$ 2 in the present element, the above formula (5) becomes $$\text{(voltage after time constant } \tau) = \text{(voltage of equilibrium state)} \times \left(1-\frac{1}{2e}\right) \quad (6)$$

Therefore, the value of the time constant $\tau$ may be measured by measuring the time when the voltage after time $\tau$ is equal to the value shown by the formula (6) above. The above given value of $\tau$ was measured by this method. It should however be remarked that the measured value of the time constant includes the rise time of the pulse generator in addition to the time constant of the element, and the rise time of the pulse generator is not considered in the above formula (5).

FIG. 11 shows the light emission decay behavior after the power source is turned off.

Thus the light emission shows exponential decay until about 40 ns, after which it shows long-time type light emission decay as determined by a recombination constant. The time until light emission decays to about 90% of the equilibrium state was approximately 300 ns.

The above results are shown in Table 1.

COMPARATIVE EXAMPLE 1

Figure 12:
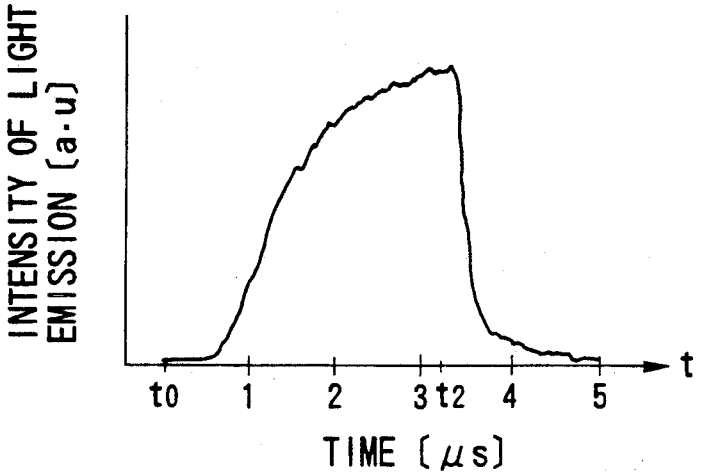
FIG. 12 is a graph showing a light emission waveform in Comparative Examples.

An element was prepared in the same manner as in Example 1, except that the area of the element surface by which the element emits light was 2×5 mm. The capacitance of the element was 2,000 PF. Measurements were made of the element in the similar manner as in Example 2 to give a light emission waveform as shown in FIG. 12, where $t_0$ and $t_2$ indicate the waveform when the power source is turned on and off, respectively. From the results of these measurements, it was found that the time until the light emission starts to rise is 550 ns, whilst the time until the waveform light emission reaches 90% of the equilibrium state was 2.2 μs. The time until the light emission decayed to 90% of the equilibrium state was 700 ns.

EXAMPLES 3 to 5 AND COMPARATIVE EXAMPLE 2

Organic EL elements were prepared in the same manner as in Example 1, and the light emission devices were prepared in the same manner as in Example 2, except changing the element area as shown in Table 1.

The time $\tau+T$ until the light emission starts to rise, the time $\tau+T+T'$ until light emission reaches 90% of its equilibrium state, the time $T''$ until light emission decays to 90% of its equilibrium state, the capacitance C of the element and the time constant $\tau$ of the element, were measured in the same manner as in Example 2.

These results are shown in Table 1.

TABLE 1

| | Area of light-emitting region ($mm^2$) | $\tau + T$ (ns) | $\tau + T + T'$ (ns) | $T''$ (ns) | Capacitance of element (PF) | Time constant (ns) |
|---|---|---|---|---|---|---|
| Comparative Example 2 | 2 × 2.5 | 350 | 1950 | 500 | 1000 | 150~200 |
| Example 3 | 1 × 2.5 | 250 | 1400 | 500 | 500 | 100 |
| Example 4 | 1 × 1.5 | 150 | 730 | 400 | 300 | 50 |
| Example 5 | 1 × 1 | 90 | 430 | 400 | 200 | 45 |
| Example 2 | 1 × 0.5 | 70 | 260 | 300 | 100 | 20* |

*The value includes the rise time of the pulse generation.

It is seen from Examples 2 to 5 and Comparative Example 1 and 2 that the rise time $\tau+T+T'$ and decay time $T''$ of light emission are strongly related with the surface area, that is the capacitance and hence the time constant of the element, such that, the smaller the capacitance of the element, the higher is its rate of response. The capacitance of the element is preferably 500 PF or less and more preferably 200 PF or less, for which the response rate is 500 ns or less.

EXAMPLE 6

Preparation of Electrical-Electrical Converter (Light Emitting Device for Light Communication)

A pulse train having the frequency of 3 MHz was prepared by a pulse generator of Example 1. This pulse generator was set as shown in FIG. 9 of the Example 2, and the pulse train was applied to the organic EL element for light emission with the pulses. The light emission was received by a S 1190 PIN photodiode produced by HAMAMATSU PHOTONICS KK, as a result of which a pulse train having a frequency of 3 MHz was reproduced. A 50 ohm terminal resistance was annexed to the PIN photodiode and the potential across its ends was measured. This Example illustrates that the electrical-electrical conversion (light communication) may proceed expeditiously.

EXAMPLE 7

Example of High Speed Modulation

A function generator was connected to the element of Example 1 and sinusoidal modulation was performed to measure the light emission response. The light emission for the frequency of 4.6 MHz was 0.707 times the light emission power for the frequency of 3 MHz (3).

Thus the 3 dB bandwidth (response frequency) was 4.6 MHz.

COMPARATIVE EXAMPLE 3

A test similar to that of Example 6 was conducted on the element of Comparative Example 1. The frequency for which the response was 0.707 times the light emission power for the frequency of +20 KHz was only 140 KHz.

EXAMPLE 8

Preparation and Evaluation of the Ultra-High-Speed Response Organic EL Element A glass substrate having an ITO electrode with a film thickness of 100 nm, prepared by HOYA KK, was ultrasonically washed for five minutes with isopropyl alcohol, and dipped in isopropyl alcohol. The glass substrate was taken out and blown by dry $N_2$ for drying. The substrate was then rinsed for about five minutes with an UV-ozone cleaning unit UV 300 prepared by SAMCO INTERNATIONAL KK, so as to be used as a supporting substrate. This substrate was attached to a substrate holder of a vacuum deposition chamber prepared by NIPPON SHINKU GIJUTSU KK. On the other hand, 200 mg of $BC_Z$ VB was charged in a Mo resistance heating evaporation boat. $BC_Z$ VB is a light emitting substance shown by the following structural formula described in EPO 0373582.

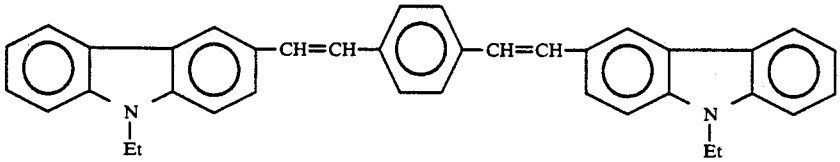

The Mo evaporation boat was attached to a current conducting terminal block of a vacuum deposition chamber, and a vacuum chamber was evacuated to $1.5\times10^{-4}$ Pa. The $BC_Z$ VB containing boat was heated for vacuum deposition of $BC_Z$ VB at a vacuum deposition rate of 1 to 3 Å/sec and a film thickness of 60 nm to produce an assembly having a layered structure of glass substrate/ITO/$BC_Z$ VB. The substrate temperature was ambient temperature. The vacuum tank was opened and, with a stainless steel mask applied to the $BC_Z$ VB layer, the substrate was attached to the substrate holder. The mask was previously prepared so that the light emission area of the element was 1 mm×0.5 mm. A Mo boat containing Mg and a W filament containing Ag were mounted on the conducting terminal block, and the vacuum chamber was evacuated to $1\times10^{-4}$ Pa. The current was conducted to the Mg-containing boat and concurrent dual vacuum deposition was effected at Mg a vacuum deposition rate of 18 to 20 Å/sec and at an Ag vacuum deposition rate of 0.6 to 0.8 Å/sec for forming a Mg; Ag layer to a film thickness of 1300 Å. This layer was used as a Mg; Ag cathode.

The response time of light emission of the produced element was measured in the same manner as in Example 2, except using a pulse generator AVR-E2-C-P-W-03, produced by ABTEC Inc., capable of providing a rise and decay of the pulse voltage of approximately 1 ns each. As a light receiving element, a photoelectron multiplier RL5640-01, prepared by HAMAMATSU PHOTONICS KK was employed, which exhibited a high-speed response and which was capable of faithfully reproducing the light emission of the EL element.

FIG. 13 shows an applied voltage waveform as measured with an oscilloscope, and EL signals as a waveform of the light emission response.

The applied voltage waveform rises sharply indicating that the time constant of the element is 5 to 6 ns, (In FIG. 10, it may be presumed that the rise of the applied waveform becomes dull due to the time constant of the element).

The corresponding waveform of the light emission shows $\tau+T\leqq6$ ns. The time until the light emission waveform reaches 90% of the equilibrium state, or the light emission rise complete time $\tau+T+T'$, is 24 ns, thus indicating an extremely high speed. On the other hand, the time until the light emission waveform decays to 90% of the equilibrium state of light emission, or the light emission decay complete time, was as short as 14 ns, thus similarly indicating an extremely high speed.

The light emitting layer (9$BC_Z$VB layer) of the present element is excellent in hole transportation and is estimated to correspond to the thickness dh and the thickness de approximately equal to 60 nm and 0 to 5 nm, respectively. It is therefore presumed that the recombination zone existed in contiguity to the cathode and the holes reach the recombination zone at an extremely high speed of 6 ns or less, where they are recombined with injected electrons. The amount of the long-life component, as the residual light component, was so small and there existed only a fluorescent light component having a short decay complete time of light emission.

EXAMPLE 8

A glass substrate/ITO/$BC_Z$ VB assembly was prepared in the same manner as in Example 7. A boat containing $Al(Ox)_3$ charged in advance into a separate Mo boat was heated to produce a 12 nm electron injection layer. The rate of deposition was 1 to 3 Å/sec, and the substrate temperature was the ambient temperature. The vacuum tank was evacuated to $1\times10^{-4}$ Pa and an Mg; Ag cathode was prepared as in Example 7.

The produced element was evaluated in the same manner as in Example 7 except using the pulse voltage of 33 V.

The RC time constant was 8 ns or less, the light emission rise complete time was 18 ns and the light emission decay complete time was 14 ns, thus indicating an extremely high speed. It is noted that separately conducted measurement of the light emission spectrum revealed that the spectrum of the element of Example 7 coincided with that of the element of Example 8 so that the $BC_Z$ VB layer was identified as a light emitting layer. Ultra high speed response could be realized since a portion within the $BC_Z$ VB layer facing the $Al(Ox)_3$ layer is a recombination zone, and also since both the hole transport time in the $BC_Z$ VB layer and the electron transport time in the $Al(Ox)_3$ layer are 14 ns or less.

We claim:

1. An organic electroluminescence element, comprising:

an anode layer;

a layer formed on said anode layer having a hole transport region and an electron transport region and having a surface for emitting light; and a cathode layer formed on said layer having the hole transport and electron transport regions, said cathode layer having a major face which is perpendicular to the direction in which the three layers are stacked, wherein said major face has a surface area which is less than or equal to 0.025 $cm^2$.

2. An organic electroluminescence element according to claim 1, wherein said element has an RC time constant less than or equal to 100 ns and a charge transport time of 600 ns or less.

3. An organic electroluminescence element according to claim 1, wherein the element has an RC time constant of 10 ns or less, and a hole transport time and electron transport time which respectively represent movement times of holes and electrons moving through said hole transport and electron transport regions, respectively, wherein said hole transport time and said electron transport time are each 40 ns or less, said element also having a light emission rise complete time and a light emission decay complete time which are each less than or equal to 50 ns.

4. An organic electroluminescence element according to claim 1, for use as a light emitting and light transmitting element in a photocoupler device.

5. An organic electroluminescence element according to claim 1, connected to a modulatable power source for use in a light emitting device in a light communication system.

6. A light emitting device comprising:

an organic electroluminescence element, said element including:

an anode layer;

a layer formed on said anode layer having a hole transport region and an electron transport region and having a surface for emitting light;

a cathode layer formed on said layer having the hole transport and electron transport regions, said cathode layer having a major face which is perpendicular to the direction in which the three layer are stacked, and wherein said major face has a surface area which is less than or equal to 0.025 $cm^2$; and a driving circuit having an RC time constant less than or equal to 100 ns.

7. A light emitting device according to claim 6, wherein said driving circuit has an RC time constant less than or equal to 10 ns.

8. A series connection of a plurality of organic electroluminescence elements, each of said elements comprising:

an anode layer;

a layer formed on said anode layer having a hole transport region and an electron transport region and having a surface for emitting light; and a cathode layer formed on said layer having the hole transport and electron transport regions, said cathode layer having a major face which is perpendicular to the direction in which the three layers are stacked, wherein said major face has a surface area which is less than or equal to 0.025 $cm^2$, an RC time constant of said series connection is less than or equal to 100 ns, and a charge transport time of each of said elements is less than or equal to 600 ns.

9. A series connection of a plurality of organic electroluminescence elements, each of said elements comprising:

an anode layer;

a layer formed on said anode layer having a hole transport region and an electron transport region and having a surface for emitting light; and a cathode layer formed on said layer having the hole transport and electron transport regions, said cathode layer having a major face which is perpendicular to the direction in which the three layers are stacked, wherein said major face has a surface area which is less than or equal to 0.025 $cm^2$, a total capacitance of the plurality of series connected elements is less than or equal to 500 picofarads, and a charge transport time of each of said elements is less than or equal to 600 ns.

* * * * *

UNITED STATES PATENT AND TRADEMARK OFFICE
CERTIFICATE OF CORRECTION

PATENT NO. : 5,216,331

DATED : June 1, 1993

INVENTOR(S) : Chishio Hosokawa et al.

It is certified that error appears in the above-identified patent and that said Letters Patent is hereby corrected as shown below:

On the title page, Item [30],

The second Foreign Application Priority Data is incorrect, should be,

--Aug. 2, 1991 [JP] Japan.....3-216244--

Signed and Sealed this

Twenty-eighth Day of December, 1993

*Attest:*

*Attesting Officer*

BRUCE LEHMAN

*Commissioner of Patents and Trademarks*